US010909897B2

(12) United States Patent
Lee et al.

(10) Patent No.: US 10,909,897 B2
(45) Date of Patent: Feb. 2, 2021

(54) GATE DRIVING CIRCUIT AND DISPLAY DEVICE HAVING THE SAME

(71) Applicant: Samsung Display Co., Ltd., Yongin-si (KR)

(72) Inventors: Jae-Han Lee, Hwaseong-si (KR); Sooyeon Kim, Namyangju-si (KR); Taegon Im, Gwangmyeong-si (KR); Jung Hwan Cho, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/556,080

(22) Filed: Aug. 29, 2019

(65) Prior Publication Data

US 2020/0143728 A1 May 7, 2020

(30) Foreign Application Priority Data

Nov. 5, 2018 (KR) ..... 10-2018-0134569

(51) Int. Cl.
*G09G 5/00* (2006.01)
*G09G 3/20* (2006.01)

(52) U.S. Cl.
CPC ..... *G09G 3/20* (2013.01); *G09G 2300/08* (2013.01); *G09G 2310/0243* (2013.01); *G09G 2310/0267* (2013.01); *G09G 2310/0275* (2013.01); *G09G 2310/0286* (2013.01); *G09G 2310/0291* (2013.01); *G09G 2310/08* (2013.01); *G09G 2330/08* (2013.01)

(58) Field of Classification Search
None
See application file for complete search history.

(56) References Cited

U.S. PATENT DOCUMENTS

2020/0074948 A1* 3/2020 Morein ..... H02M 3/07

FOREIGN PATENT DOCUMENTS

| | | | |
|---|---|---|---|
| KR | 10-0272551 | B1 | 11/2000 |
| KR | 10-0721047 | B1 | 5/2007 |
| KR | 10-1205769 | B1 | 11/2012 |
| KR | 10-1303736 | B1 | 9/2013 |
| KR | 10-1308456 | B1 | 9/2013 |
| KR | 10-1430983 | B1 | 8/2014 |

* cited by examiner

*Primary Examiner* — Adam R. Giesy
(74) *Attorney, Agent, or Firm* — Lewis Roca Rothgerber Christie LLP

(57) ABSTRACT

A gate driving circuit includes a shift register configured to generate a plurality of output signals based on at least one clock signal, a plurality of output buffers configured to generate a plurality of gate signals by amplifying the output signals and to sequentially output the gate signals to a plurality of gate lines in a display panel, a detector configured to sequentially sense the gate signals and to compare each of the gate signals to a reference voltage, and a dummy output buffer configured to be coupled between the shift register and a gate line of the gate lines instead of an output buffer of the output buffers when a voltage level of a corresponding gate signal from the output buffers is less than a voltage level of the reference voltage.

20 Claims, 9 Drawing Sheets

GATE DRIVING CIRCUIT AND DISPLAY DEVICE HAVING THE SAME

CROSS-REFERENCE TO RELATED APPLICATION

This application claims priority to and the benefit of Korean Patent Application No. 10-2018-0134569, filed on Nov. 5, 2018 in the Korean Intellectual Property Office (KIPO), the content of which is incorporated herein in its entirety by reference.

BACKGROUND

1. Field

Example embodiments relate generally to a gate driving circuit and a display device having the same.

2. Description of the Related Art

Generally, a display device includes a display panel and a display panel driver. The display panel may include a plurality of pixels, a plurality of gate lines, and a plurality of data lines. The display panel driver may include a gate driver that provides gate signals to the gate lines, a data driver that provides data signals to the data lines, and a timing controller that controls the gate driver and the data driver.

The gate driver may include a shift register and an output buffer. The shift register may include a plurality of stages connected each other. An output signal of the stage may be provided to the gate line of the display panel through the output buffer. When an abnormality occurs in the output buffer, a voltage level of the gate line may change and a problem may occur in the display device.

SUMMARY

Aspects of some example embodiments are directed toward a gate driving circuit capable of reducing or preventing a gate line defect of a display device.

Aspects of some example embodiments are directed toward a display device capable of reducing or preventing a gate line defect.

In example embodiments, a gate driving circuit may include a shift register configured to generate a plurality of output signals based on at least one clock signal, a plurality of output buffers configured to generate a plurality of gate signals by amplifying the output signals and to sequentially output the gate signals to a plurality of gate lines in a display panel, a detector configured to sequentially sense the gate signals and to compare each of the gate signals to a reference voltage, and a dummy output buffer configured to be coupled between the shift register and a gate line of the gate lines instead of an output buffer of the output buffers when a voltage level of a corresponding gate signal from the output buffers is less than a voltage level of the reference voltage.

In example embodiments, each of the output buffers may include an amplifier configured to generate a corresponding gate signal by amplifying a corresponding output signal, a first switch coupled between the shift register and the amplifier, and a second switch coupled between the amplifier and a corresponding gate line.

In example embodiments, the dummy output buffer may include a dummy amplifier configured to generate the gate signal by amplifying the output signal, a third switch coupled between the shift register and the dummy amplifier, fourth switch coupled between the dummy amplifier and the gate line, and a fifth switch coupled between the dummy amplifier and the gate line.

In example embodiments, the detector may include a comparator configured to compare each of the gate signals output from the output buffers to the reference voltage, a sixth switch coupled between the output buffers and the comparator, and a buffer controller configured to generate a buffer control signal to control the first through fifth switches based on an output of the comparator.

In example embodiments, when the voltage level of the gate signal from the output buffer is greater than or equal to the voltage level of the reference voltage, the first switch of the output buffer and the second switch of the output buffer may turn on based on the buffer control signal.

In example embodiments, when the voltage level of the gate signal from the output buffer is less than the voltage level of the reference voltage, the third switch, the fourth switch, and the fifth switch may turn on based on the buffer control signal.

In example embodiments, the detector may sense each of the gate signals output from the output buffers when the sixth switch turns on.

In example embodiments, the first through fifth switches may be p-channel metal oxide semiconductor transistors.

In some example embodiments, the first through fifth switches may be n-channel metal oxide semiconductor transistors.

In some example embodiments, the first switch and the second switch may be p-channel metal oxide semiconductor transistors, and the third switch, the fourth switch, and the fifth switch may be n-channel metal oxide semiconductor transistors.

In some example embodiments, the first switch and the second switch may be n-channel metal oxide semiconductor transistors, and the third switch, the fourth switch, and the fifth switch may be p-channel metal oxide semiconductor transistors.

According to some example embodiments, a display device may include a display panel including a plurality of gate lines, a plurality of data lines, and a plurality of pixels, a gate driver configured to provide a plurality of gate signals to the pixels through the gate lines, a data driver configured to provide a plurality of data signals to the pixels through the data lines, and a timing controller configured to generate a plurality of control signals to control the gate driver and the data driver. The gate driver may include a shift register configured to generate a plurality of output signals based on at least one clock signal, a plurality of output buffers configured to generate the gate signals and sequentially output the gate signals to the gate lines, a detector configured to sequentially sense the gate signals and compare each of the gate signals to a reference voltage, and a dummy output buffer configured to be coupled between the shift register and a gate line of the gate lines instead of an output buffer of the output buffers when a voltage level of a corresponding gate signal from the output buffer is less than a voltage level of the reference voltage.

In example embodiments, each of the output buffers may include an amplifier configured to generate a corresponding gate signal by amplifying a corresponding output signal, a first switch coupled between the shift register and the amplifier, and a second switch coupled between the amplifier and a corresponding gate line.

In example embodiments, the dummy output buffer may include a dummy amplifier configured to generate the gate signal by amplifying the output signal, a third switch coupled between the shift register and the dummy amplifier, fourth switch coupled between the dummy amplifier and the gate line and a fifth switch coupled between the dummy amplifier and the gate line.

In example embodiments, the detector may include a comparator configured to compare each of the gate signals output from the output buffers to the reference voltage, a sixth switch coupled between the output buffers and the comparator, and a buffer controller configured to generate a buffer control signal to control the first through fifth switches based on an output of the comparator.

In example embodiments, when the voltage level of the gate signal from the output buffer is greater than or equal to the voltage level of the reference voltage, the first switch of the output buffer and the second switch of the output buffer may turn on based on the buffer control signal.

In example embodiments, when the voltage level of the gate signal from the output buffer is less than the voltage level of the reference voltage, the third switch, the fourth switch, and the fifth switch may turn on based on the buffer control signal.

In example embodiments, the detector may sense each of the gate signals output from the output buffers when the sixth switch turns on.

In example embodiments, the detector may sense each of the gate signals output from the output buffers at a power-on timing of the display device.

In example embodiments, the detector may sense each the gate signals output from the output buffers during a vertical blank period in a frame.

Therefore, the gate driving circuit and the display device having the same may sense each of the gate signals output through the gate lines and may couple the dummy amplifier of the dummy output buffer between the shift register and the gate line when the voltage level of the gate signal from an output buffer is less than the voltage level of the reference voltage, so that a gate line defect in the display panel may be reduced or prevented.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Hereinafter, the present inventive concept will be explained in more detail with reference to the accompanying drawings.

Figure 1:
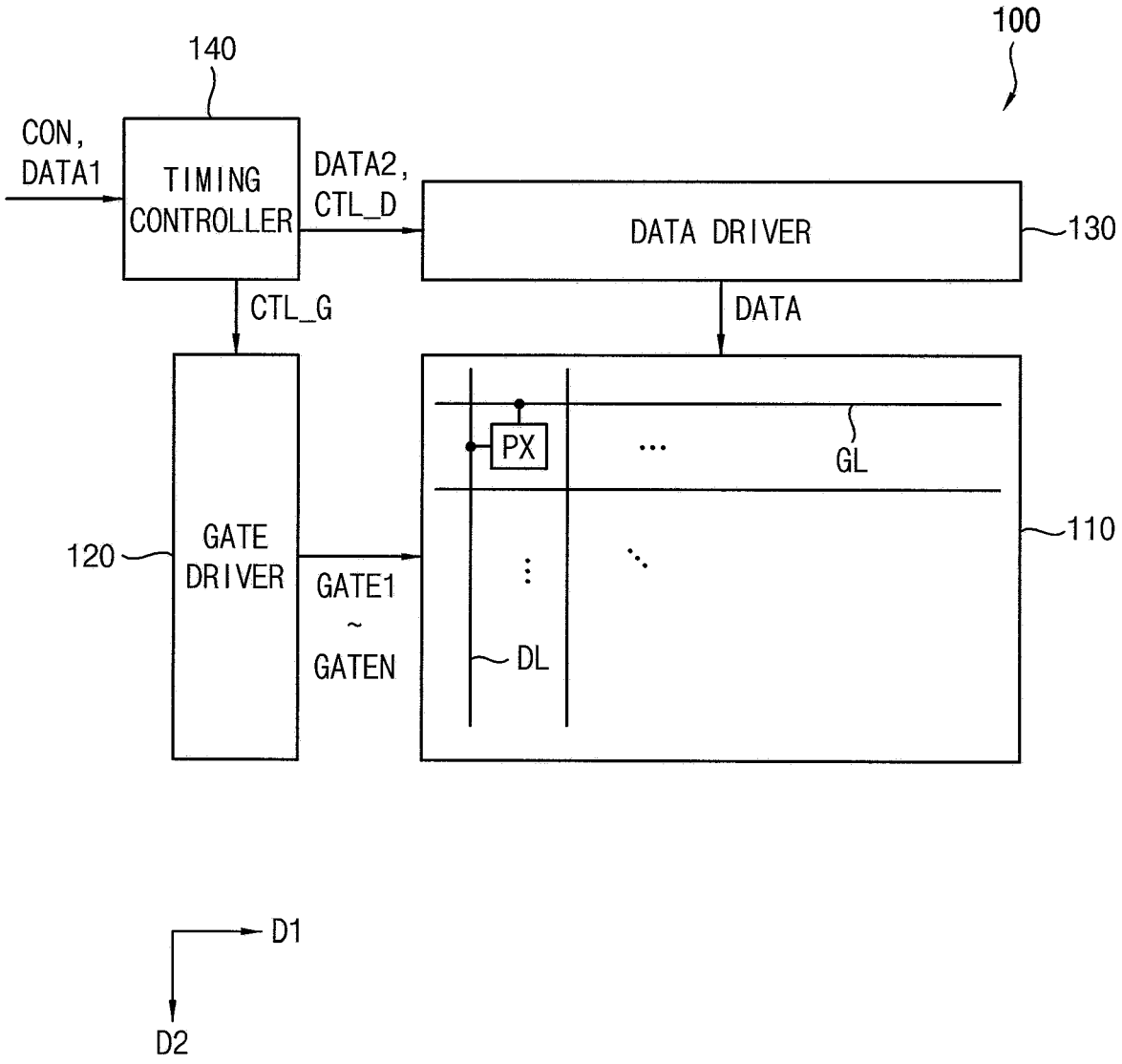
FIG. 1 is a block diagram illustrating a display device according to example embodiments.
Figure 2:
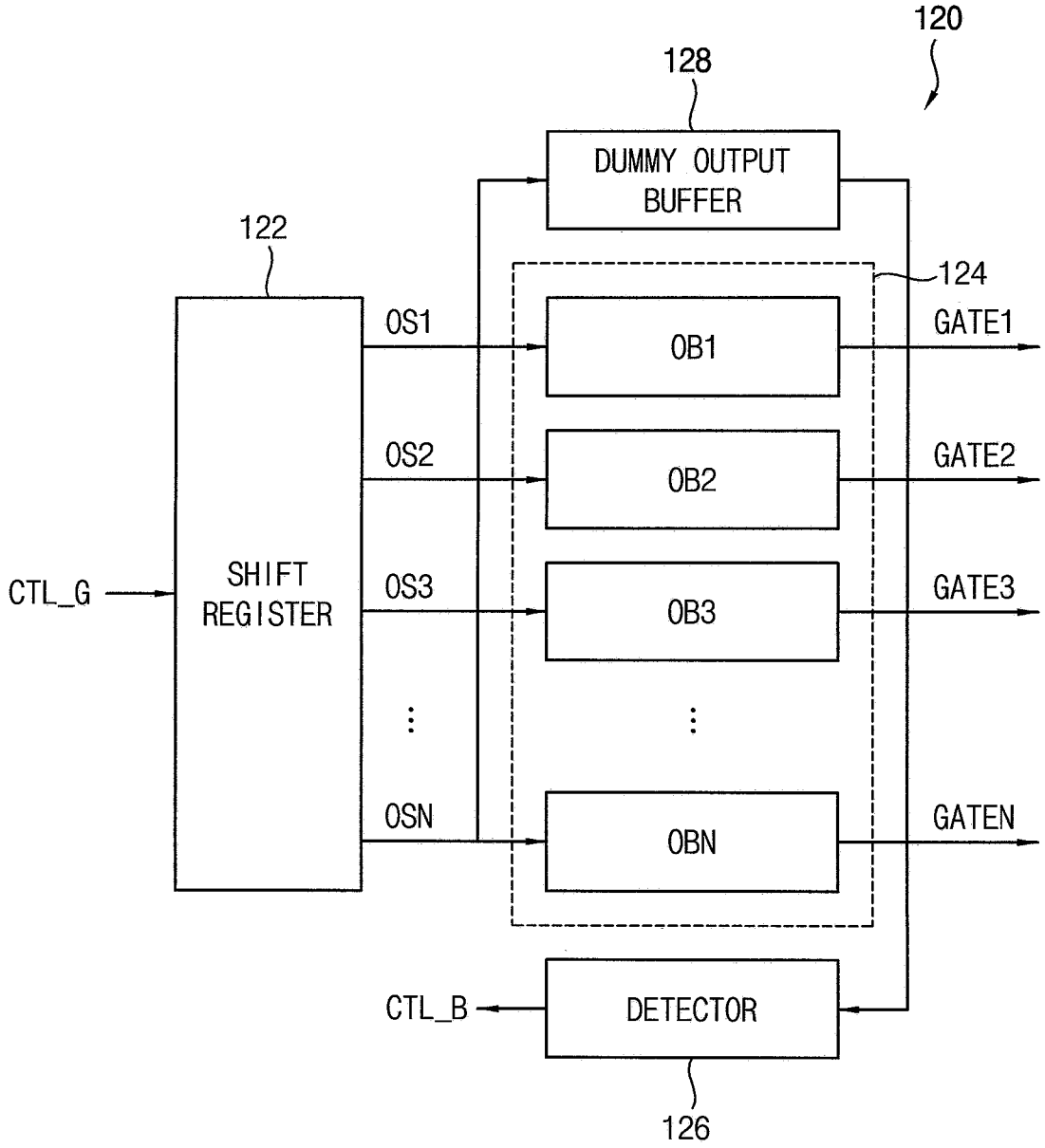
FIG. 2 is a block diagram illustrating a gate driver included in the display device of FIG. 1.
Figure 3:
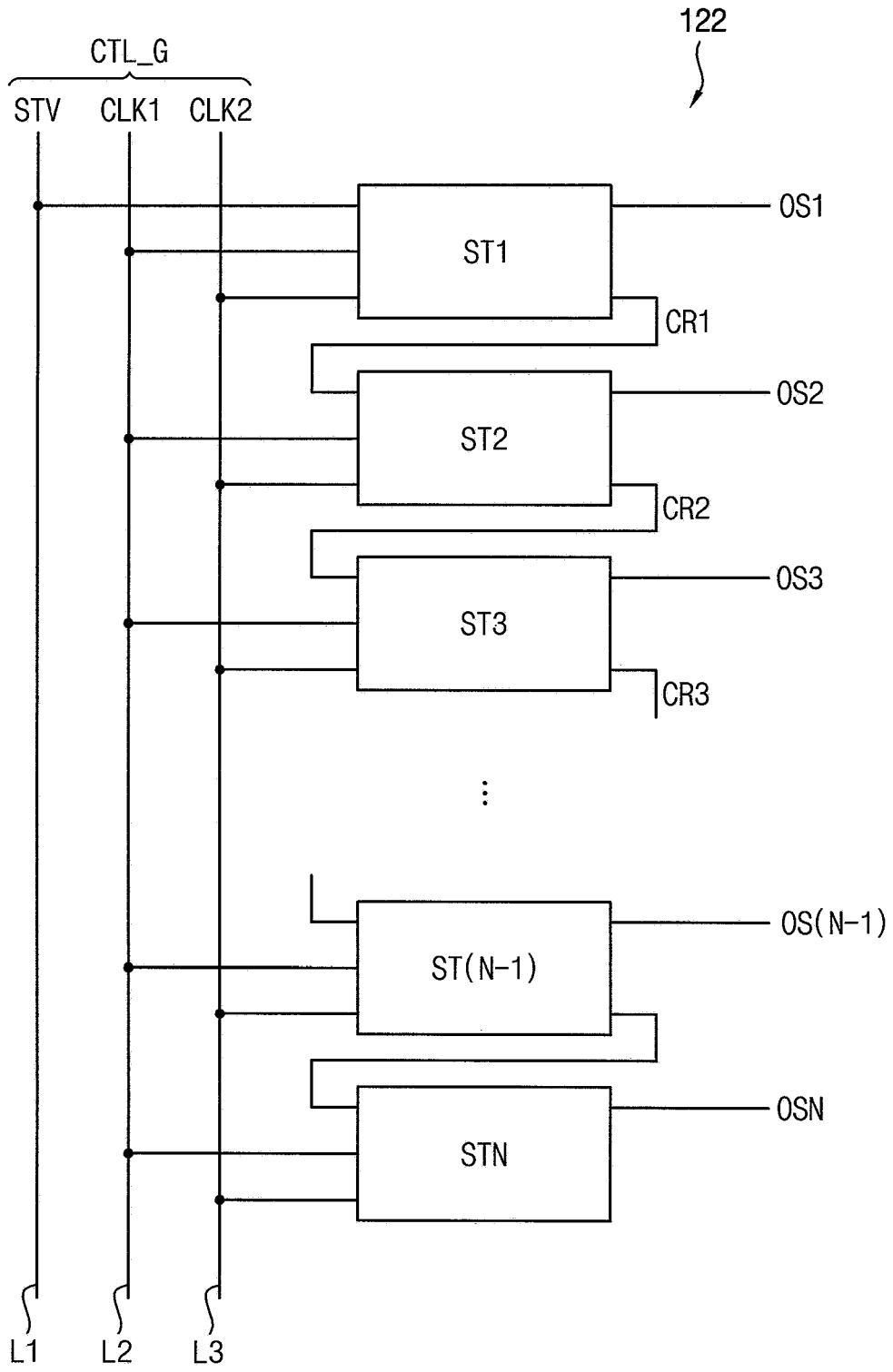
FIG. 3 is a block diagram illustrating an example of a shift register included in the gate driver of FIG. 2.

FIG. 1 is a block diagram illustrating a display device according to example embodiments. FIG. 2 is a block diagram illustrating a gate driver included in the display device of FIG. 1. FIG. 3 is a block diagram illustrating an example of a shift register included in the gate driver of FIG. 2.

Referring to FIG. 1, a display device 100 may include a display panel 110, a gate driver 120, a data driver 130, and a timing controller 140.

The display panel 110 may include a plurality of gate lines GL, a plurality of data lines DL, and a plurality of pixels PX each electrically coupled to corresponding ones of the gate lines GL and the data lines DL. The gate lines GL may extend in a first direction D1 and be arranged with each other in a second direction perpendicular to or crossing the first direction D1. The data lines DL may extend in the second direction D2 and be arranged with each other in the first direction D1. Each of the pixels PX may include a switching element, a liquid crystal capacitor, and a storage capacitor electrically coupled to the switching element. The switching element may be a thin film transistor. The liquid crystal capacitor may include a first electrode coupled to a pixel electrode to receive a data voltage, and a second electrode coupled to a common electrode to receive a common voltage. The storage capacitor may include a first electrode coupled to the pixel electrode to receive the data voltage and a second electrode coupled to a storage electrode to receive a storage voltage. The storage voltage may have a same value with the common voltage.

The timing controller 140 may convert a first image data DATA1 provided by an external device to a second image data DATA2, may generate a gate control signal CTL_G, and may generate a data control signal CTL_D that control a driving of the second image data DATA2. The timing controller 140 may convert the first image data DATA1 to the second image data DATA2 by performing an image enhancement algorithm (e.g., a dynamic capacitance compensation (DCC)). When the timing controller 140 does not include the image enhancement algorithm, the first image data IMG1 may be output as the second image data IMG2. The timing controller 140 may receive a control signal CON from the external device. may generate the gate control signal CTL_G to provide to the gate driver 120, and may generate the data control signal CTL_D to provide to the data driver 130. For example, the gate control signal CTL_G may include a vertical start signal and at least one clock signal. For example, the data control signal CTL_D may include a horizontal start signal and at least one clock signal.

The gate driver 120 may provide gate signals GATE1 through GATEN to the pixels PX through the gate lines GL. The gate driver 120 may generate the gate signals GATE1 through GATEN based on the gate control signal CTL_G provided from the timing controller 140. Referring to FIG. 2, the gate driver 120 may include a shift register 122, output buffers 124, a detector 126, and a dummy output buffer 128.

The shift register 122 may generate a plurality of output signals OS1 through OSN based on at least one clock signal (e.g., the first clock signal CLK1 and/or the second clock signal CLK2). Referring to FIG. 3, the shift register 122 may include a plurality of stages ST1 through STN. The stages ST1 through STN may be dependently coupled. Each of the stages ST1 through STN may sequentially output the output signals OS1 through OSN. Each of the stages ST1 through STN may receive the gate control signal CTL_G from the timing controller 140. The gate control signal CTL_G may include the vertical start signal and at least one clock signal (e.g., the first clock signal CLK1 and/or the second clock signal CLK2). For example, the stages ST1 through STN of FIG. 3 may receive the gate control signal CTL_G that includes a vertical start signal STV, a first clock signal CLK1, and a second clock signal CLK2. Each of the stages ST1 through STN may be coupled to a second line L2 and receive the first clock signal CLK1 through the second line L2. Each of the stages ST1 through STN may be coupled to a third line L3 and receive the second clock signal CLK2 through the third line L3. The first stage ST1 may be coupled to a first line L1 and receive the vertical start signal STV through the first line L1. The other stages ST2 through STN excluding the first stage ST1 may receive carry signals CR1 through CR(N−1) output from a previous stage. For example, the carry signals CR1 through CR(N−1) may be the same signal output form the output signals OS1 through OSN output from the previous stage.

The first stage ST1 may generate a first output signal OS1 based on the vertical start signal STV, the first clock signal CLK1, and the second clock signal CLK2. The first output signal OS1 generated in the first stage ST1 may be provided to a first output buffer OB1 coupled to a first gate line formed in a first column of the display panel 110. Here, the output signal OS1 may be provided to a second stage ST2 as a first carry signal CR1.

The second stage ST2 may generate a second output signal OS2 based on the first carry signal CR1, the first clock signal CLK1, and the second clock signal CLK2. The second output signal OS2 generated in the second stage ST2 may be provided to a second output buffer OB2 coupled to a second gate line formed in a second column of the display panel 110. Here, the second output signal OS2 may be provided to a third stage ST3 as a second carry signal CR2.

The third stage ST3 may generate a third output signal OS3 based on the second carry signal CR2, the first clock signal CLK1, and the second clock signal CLK2. The third output signal OS3 generated in the third stage ST3 may be provided to a third output buffer OB3 coupled to a third gate line formed in a third column of the display panel 110. Here, the third output signal OS3 may be provided to a fourth stage as a third carry signal CR3.

An Nth stage STN may generate an Nth output signal OSN based on a (N−1)th carry signal CR(N−1), the first clock signal CLK1, and the second clock signal CLK2, where the N is an integer equal to or greater than 2. The Nth output signal OSN generated in the Nth stage STN may be provided to an Nth output buffer OBN coupled to an Nth gate line formed in an Nth column of the display panel 110.

As described above, the stages ST1 through STN of the shift register 122 may be dependently coupled and sequentially output the output signals OS1 through OSN. That is, the first stage ST1 may generate the first output signal OS1 based on the vertical start signal STV, the first clock signal CLK1, and the second clock signal CLK2. The Nth stage STN may generate the Nth output signal OSN based on the (N−1)th carry signal CR(N−1), the first clock signal CLK1, and the second clock signal CLK2.

Referring to FIG. 2, the gate driver 120 may include a plurality of output buffers 124. The output buffers 124 may generate the gate signals GATE1 through GATEN by amplifying the output signals OS1 through OSN provided from the shift register 122 and output the gate signals GATE1 through GATEN to the gate lines GL of the display panel 110. The first output buffer OB1 may generate a first gate signal GATE1 by amplifying the first output signal OS1 provided from the shift register 122 and may output the first gate signal GATE1 to the first gate line formed in the first column of the display panel 110. The second output buffer OB2 may generate a second gate signal GATE2 by amplifying the second output signal OS1 provided from the shift register 122 and may output the second gate signal GATE2 to the second gate line formed in the second column of the display panel 110. The third output buffer OB3 may generate a third gate signal GATE3 by amplifying the third output signal OS3 provided from the shift register 122 and may output the third gate signal GATE3 to the third gate line formed in the third column of the display panel 110. The Nth output buffer OBN may generate a Nth gate signal GATEN by amplifying the Nth output signal OSN provided from the shift register 122 and may output the Nth gate signal GATEN to the Nth gate line formed in the Nth column of the display panel 110. The first through Nth output buffers 124 may sequentially output the first through Nth gate signals GATE1 through GATEN to the first through Nth gate lines of the display panel 110. When an abnormality occurs in one of the first through Nth output buffers OB1 through OBN, a normal or desired gate signal may not be provided to the gate line coupled to the output buffer, thereby causing a gate line defect.

The detector 126 may sequentially sense the gate signals GATE1 through GATEN and compare each of the gate signals GATE1 through GATEN to a reference voltage. The detector 126 may sequentially sense the first through Nth gate signals GATE1 through GATEN that are sequentially output from the first through Nth output buffers OB1 through OBN. The detector 126 may compare each of the first through Nth gate signals GATE1 through GATEN to the set or predetermined reference voltage. The detector 126 may compare a voltage level of each of the first through Nth gate signals GATE1 through GATEN to a voltage level of the reference voltage and may output a buffer control signal CTL_B based on a comparing result. The detector 126 may output the buffer control signal CTL_B that couples the output buffer that outputs a gate signal when the voltage level is greater than or equal to the voltage level of the reference voltage between the shift register 122 and the gate line. The detector 126 may output the buffer control signal CTL_B that couples the dummy output buffer 128 instead of the output buffer that outputs the gate signal when the voltage level is less than the voltage level of the reference voltage between the shift register 122 and the gate line. That is, when the voltage level of the gate signal is less than the voltage level of the reference voltage, the dummy output buffer may be coupled between the shift register 122 and the gate line instead of the output buffer that outputs the gate signal of which the voltage level is less than the voltage level of the reference voltage, so that the gate signal having a voltage level at a normal or desired level may be output.

The data driver 130 may generate the data signal DATA corresponding to the second image data DATA2 based on the data control signal CTL_D and provide the data signal DATA to the pixels PX of the display panel 110 through the data lines DL.

As described above, the display device 100 of FIG. 1 may sense each of the gate signals GATE1 through GATEN output through the gate lines, and couple the dummy output buffer 128 between the shift register 122 and the gate line GL when the voltage level of the gate signal is less than the voltage level of the reference voltage, so that a gate line defect in the display panel 110 may be reduced or prevented.

Figure 4:
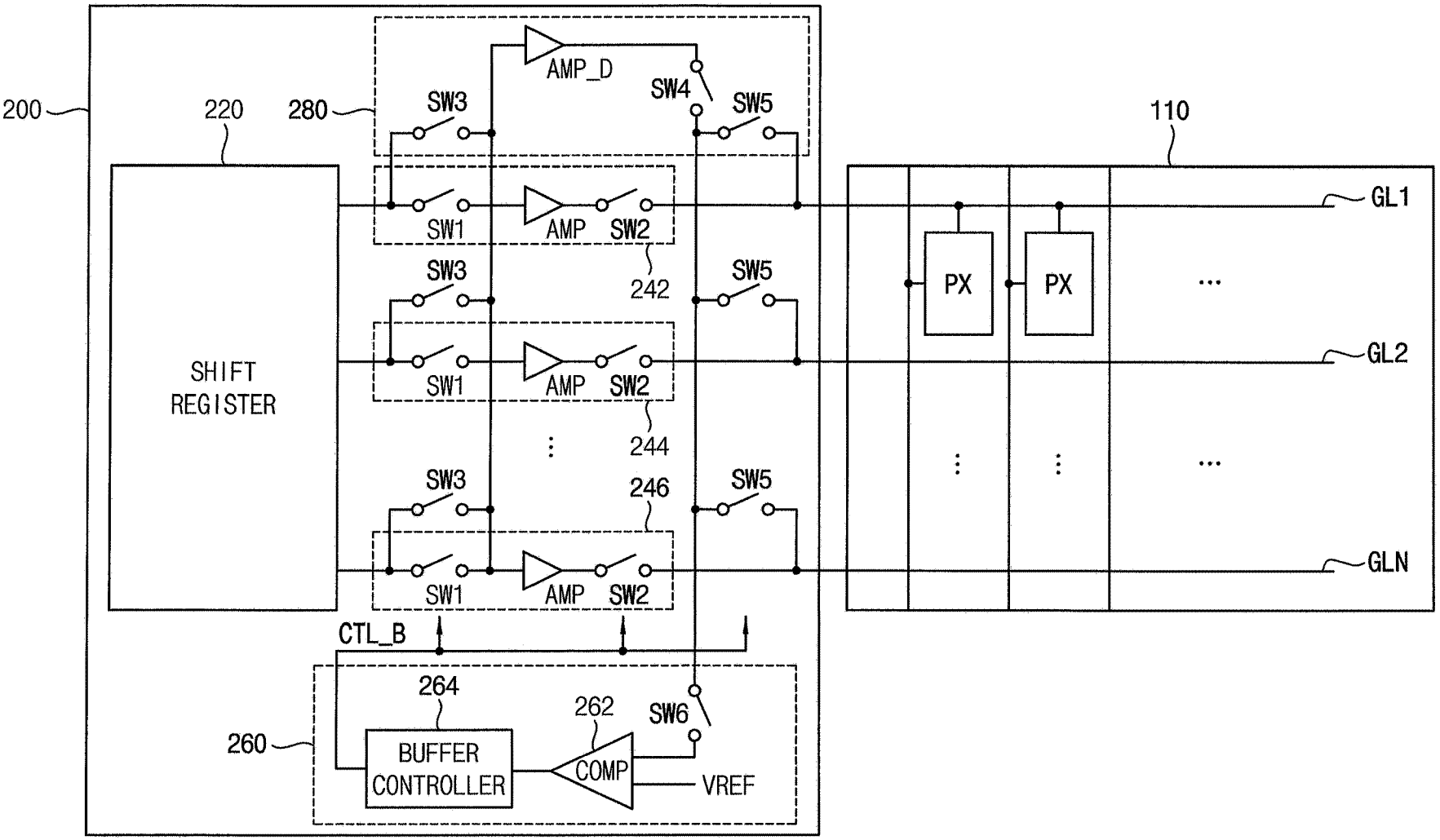
FIG. 4 is a diagram illustrating a gate driver and a display panel included in the display device of FIG. 1.

FIG. 4 is a diagram illustrating a gate driver and a display panel included in the display device of FIG. 1.

The gate driver 200 of FIG. 4 may correspond to the gate driver 120 of FIG. 1. Referring to FIG. 4, the gate driver 200 may include the shift register 220, output buffers 242, 244, 246, the detector 260, and the dummy output buffer 280.

The shift register 220 may include the plurality of stages. Each of the stages may sequentially generate the output signal based on the vertical start signal, the carry signal, and/or the clock signal.

Each of the output buffers 242, 244, 246 may correspond to each of the stages of the shift register 220 and each of the gate lines GL1 through GLN. Each of the output buffers 242, 244, 246 may include an amplifier AMP, a first switch SW1, and a second switch SW2. The amplifier AMP may generate the gate signal by amplifying the output signal output from the shift register 220. The first switch SW1 may be coupled between one of the stages of the shift register 220 and the amplifier AMP. The first switch SW1 may turn on or turn off in response to the buffer control signal CTL_B. When the first switch SW1 turns on, the shift register 220 and the amplifier AMP may be coupled. The second switch SW2 may be coupled between the amplifier AMP and one of the gate lines GL1 through GLN. The second switch SW2 may turn on or turn off in response to the buffer control signal CTL_B. When the second switch SW2 turns on, the amplifier AMP of one of the output buffers (e.g., output buffers 242, 244, 246) and one of the gate line GL1 through GLN may be coupled.

The dummy output buffer 280 may be arranged to be above or below the output buffers 242, 244, 246. The dummy output buffer 280 may include a dummy amplifier AMP_D, a third switch SW3, a fourth switch SW4, and a fifth switch SW5. The dummy amplifier AMP_D may generate the gate signal by amplifying the output signal output from the shift register 220. The third switch SW3 may be coupled between the shift register 220 and the dummy amplifier AMP_D. The third switch SW3 may turn on or turn off in response to the buffer control signal CTL_B. When the third switch SW3 turns on, the shift register 220 and the dummy amplifier AMP_D may be coupled. The fourth switch SW4 and the fifth switch SW5 may be between the dummy amplifier AMP_D and one of the gate lines GL1 through GLN. The fourth switch SW4 and the fifth switch SW5 may turn or turn off in response to the buffer control signal CTL_B. When the fourth switch SW4 and the fifth switch SW5 turn on, the dummy amplifier AMP_D and the one of the gate lines GL1 through GLN may be coupled.

The detector 260 may sequentially sense the gate signals. The detector 260 may include a comparator 262, a sixth switch SW6, and a buffer controller 264. The comparator 262 may compare each of the gate signals output from each of the output buffers 242, 244, 246 to the reference voltage VREF. The sixth switch SW6 may be coupled between the output buffers 242, 244, 246 and the comparator 262. In some example embodiments, the sixth switch SW6 may turn on at a power-on timing of the display device. In other example, the sixth switch may turn on during a vertical blank period in a frame. When the sixth switch SW6 turns on, the gate signal provided to one of the gate lines GL1 through GLN may be provided to the comparator 262. The comparator 262 may sequentially compare each of the gate signals to the reference voltage because the gate signals are sequentially output. The buffer controller 264 may generate the buffer control signal CTL_B that controls the first through fifth switches SW1 through SW5 based on an output of the comparator 262. When the voltage level of the gate signal is greater than or equal to the voltage level of the reference voltage VREF, the buffer controller 264 may output the buffer control signal CTL_B that turns on the first switch SW1 and the second switch SW2 and couple the amplifier AMP included in one of the output buffers 242, 244, 246 between the shift register 220 and one of the gate lines GL1 through GLN. When the voltage level of the gate signal is less than the voltage level of the reference voltage VREF, the buffer controller 264 may output the buffer control signal CTL_B that turns on the third switch SW3, the fourth switch SW4, and the fifth switch SW5 and coupled the dummy amplifier AMP_D included in the dummy output buffer 280 between the shift register 220 and one of the gate lines GL1 through GLN.

FIGS. 5A through 5D are diagrams illustrating an example of an output buffer and a dummy buffer included in the gate driver of FIG. 4.

Figure 5A:
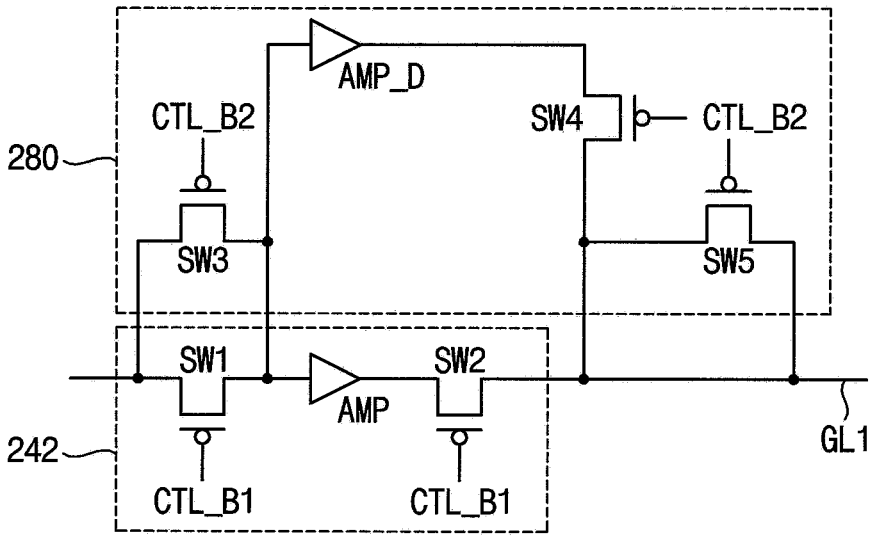
FIGS. 5A-5D are diagrams illustrating an example of an output buffer and a dummy buffer included in the gate driver of FIG. 4.

Referring to FIG. 5A, the first through fifth switches SW1 through SW5 may be p-channel metal oxide semiconductor (PMOS) transistors. The first through fifth switches SW1 through SW5 may turn on in response to a signal having a low level and turn off in response to a signal having a high level. For example, when the voltage level of the gate signal is greater than or equal to the voltage level of the reference voltage, the detector 260 may provide a first buffer control signal CTL_B1 having the low level to the first switch SW1 and the second switch SW2 and provide a second buffer control signal CTL_B2 having the high level to the third switch SW3, the fourth switch SW4, and the fifth switch SW5. In this case, the first switch SW1 and the second switch SW2 may turn on, and the amplifier AMP of the output buffer 242 may be coupled between the shift register and the first gate line GL1. When the voltage level of the gate signal is less than the voltage level of the reference voltage, the detector 260 may provide the first buffer control signal CTL_B1 having the high level to the first switch SW1 and the second switch SW2 and provide the second buffer control signal CTL_B2 having the low level to the third switch SW3, the fourth switch SW4, and the fifth switch SW5. In this case, the third switch SW3, the fourth switch SW4, and the fifth switch SW5 may turn on, and the dummy amplifier AMP_D of the dummy output buffer 280 may be coupled between the shift register and the first gate line GL1.

Figure 5B:
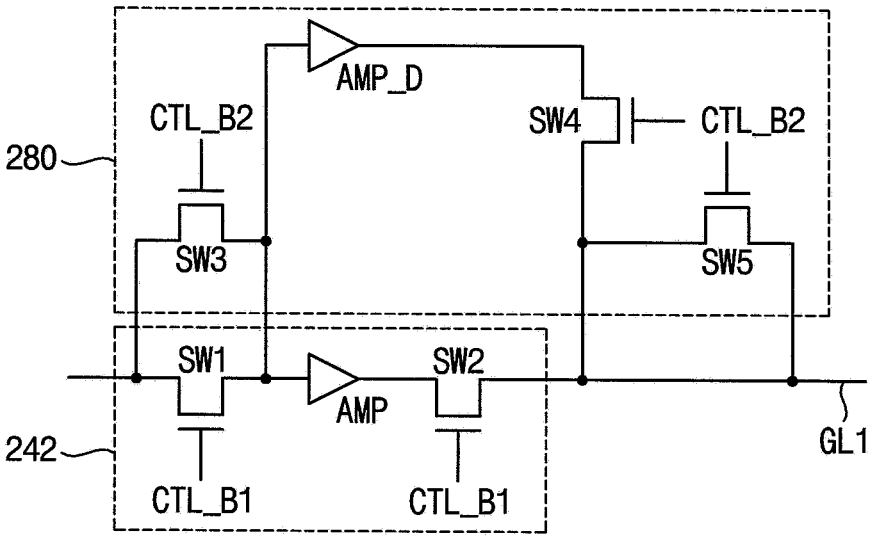

Referring to FIG. 5B, the first through fifth switches SW1 through SW5 may be n-channel metal oxide semiconductor (NMOS) transistors. The first through fifth switches SW1 through SW5 may turn on in response to a signal having the high level and turn off in response to a signal having the low level. For example, when the voltage level of the gate signal is greater than or equal to the voltage level of the reference voltage, the detector 260 may provide a first buffer control signal CTL_B1 having the high level to the first switch SW1 and the second switch SW2 and provide a second buffer control signal CTL_B2 having the low level to the third switch SW3, the fourth switch SW4, and the fifth switch SW5. In this case, the first switch SW1 and the second switch SW2 may turn on, and the amplifier AMP of the output buffer 242 may be coupled between the shift register the first gate line GL1. When the voltage level of the gate signal is less than the voltage level of the reference voltage, the detector 260 may provide the first buffer control signal CTL_B1 having the low level to the first switch SW1 and the second switch SW2 and provide the second buffer control signal CTL_B2 having the high level to the third switch SW3, the fourth switch SW4, and the fifth switch SW5. In this case, the third switch SW3, the fourth switch SW4, and the fifth switch SW5 may turn on, and the dummy amplifier AMP_D of the dummy output buffer 280 may be coupled between the shift register and the first gate line GL1.

Figure 5C:
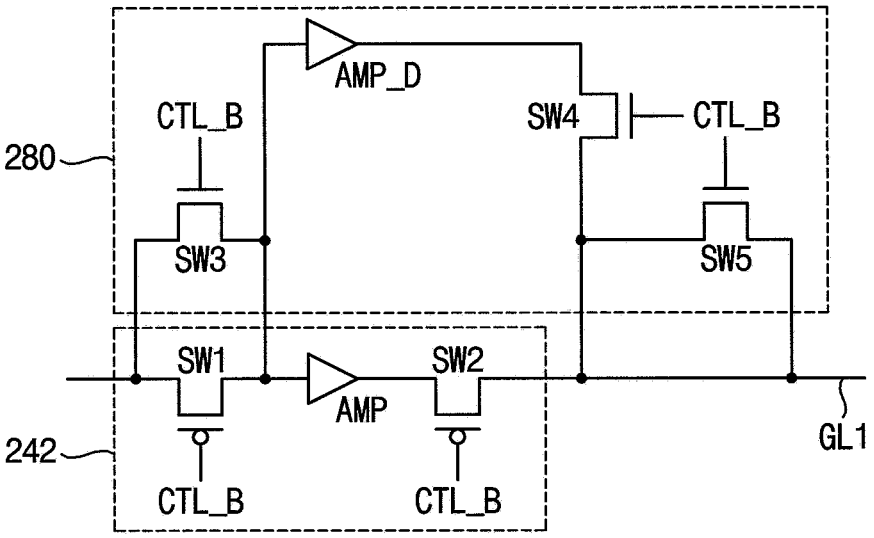

Referring to FIG. 5C, the first switch SW1 and the second switch SW2 may be the p-channel metal oxide semiconductor (PMOS) transistors, and the third switch SW3, the fourth switch SW4, and the fifth switch SW5 may be the n-channel metal oxide semiconductor (NMOS) transistors. The first switch SW1 and the second switch SW2 may turn on in response to a signal having the low level and turn off in response to a signal having the high level. The third switch SW3, the fourth switch SW4, and the fifth switch SW5 may turn on in response to the signal having the high level and turn off in response to the signal having the low level. When the voltage level of the gate signal is greater than or equal to the voltage level of the reference voltage, the detector 260 may provide the buffer control signal CTL_B having the low level to the first through fifth switches SW1 through SW5. In this case, the first switch SW1 and the second switch SW2 may turn on, and the amplifier AMP of the output buffer 242 may be coupled between the shift register and the first gate line GL1. When the voltage level of the gate signal is less than the voltage level of the reference voltage, the detector 260 may provide the buffer control signal CTL_B having the high level to the first through fifth switches SW1 through SW5. In this case, the third switch SW3, the fourth switch SW4, and the fifth switch SW5 may turn on, and the dummy amplifier AMP_D of the dummy output buffer 280 may be coupled between the shift register and the first gate line GL1.

Figure 5D:
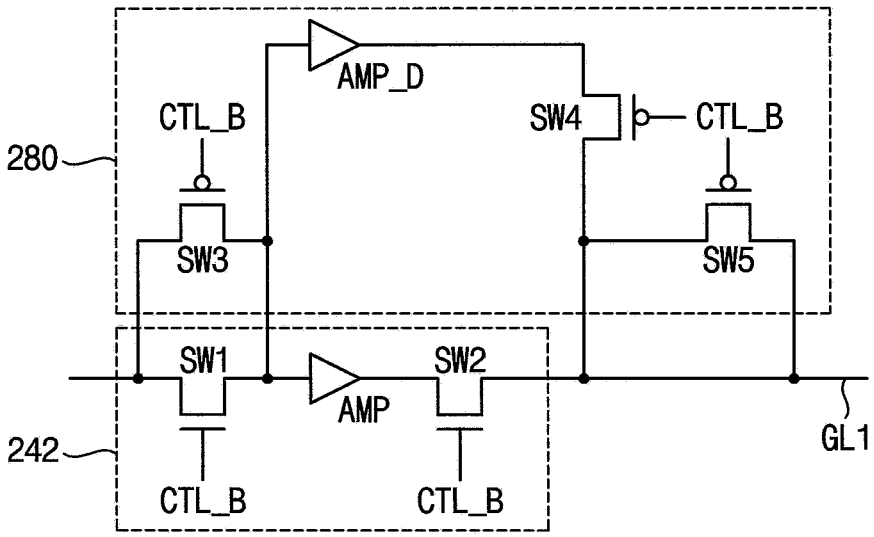

Referring to FIG. 5D, the first switch SW1 and the second switch SW2 may be the n-channel metal oxide semiconductor (NMOS) transistors, and the third switch SW3, the fourth switch SW4, and the fifth switch SW5 may be the p-channel metal oxide semiconductor (PMOS) transistors. The first switch SW1 and the second switch SW2 may turn on in response to a signal having the high level and turn off in response to a signal having the low level. The third switch SW3, the fourth switch SW4, and the fifth switch SW5 may turn on in response to the signal having the low level and turn off in response to the signal having the high level. When the voltage level of the gate signal is greater than or equal to the voltage level of the reference voltage, the detector 260 may provide the buffer control signal CTL_B having the high level to the first through fifth switches SW1 through SW5. In this case, the first switch SW1 and the second switch SW2 may turn on, and the amplifier AMP of the output buffer 242 may be coupled between the shift register and the first gate line GL1. When the voltage level of the gate signal is less than the voltage level of the reference voltage, the detector 260 may provide the buffer control signal CTL_B having the low level to the first through fifth switches SW1 through SW5. In this case, the third switch SW3, the fourth switch SW4, and the fifth switch SW5 may turn on, and the dummy amplifier AMP_D of the dummy output buffer 280 may be coupled between the shift register and the first gate line GL1.

Figure 6A:
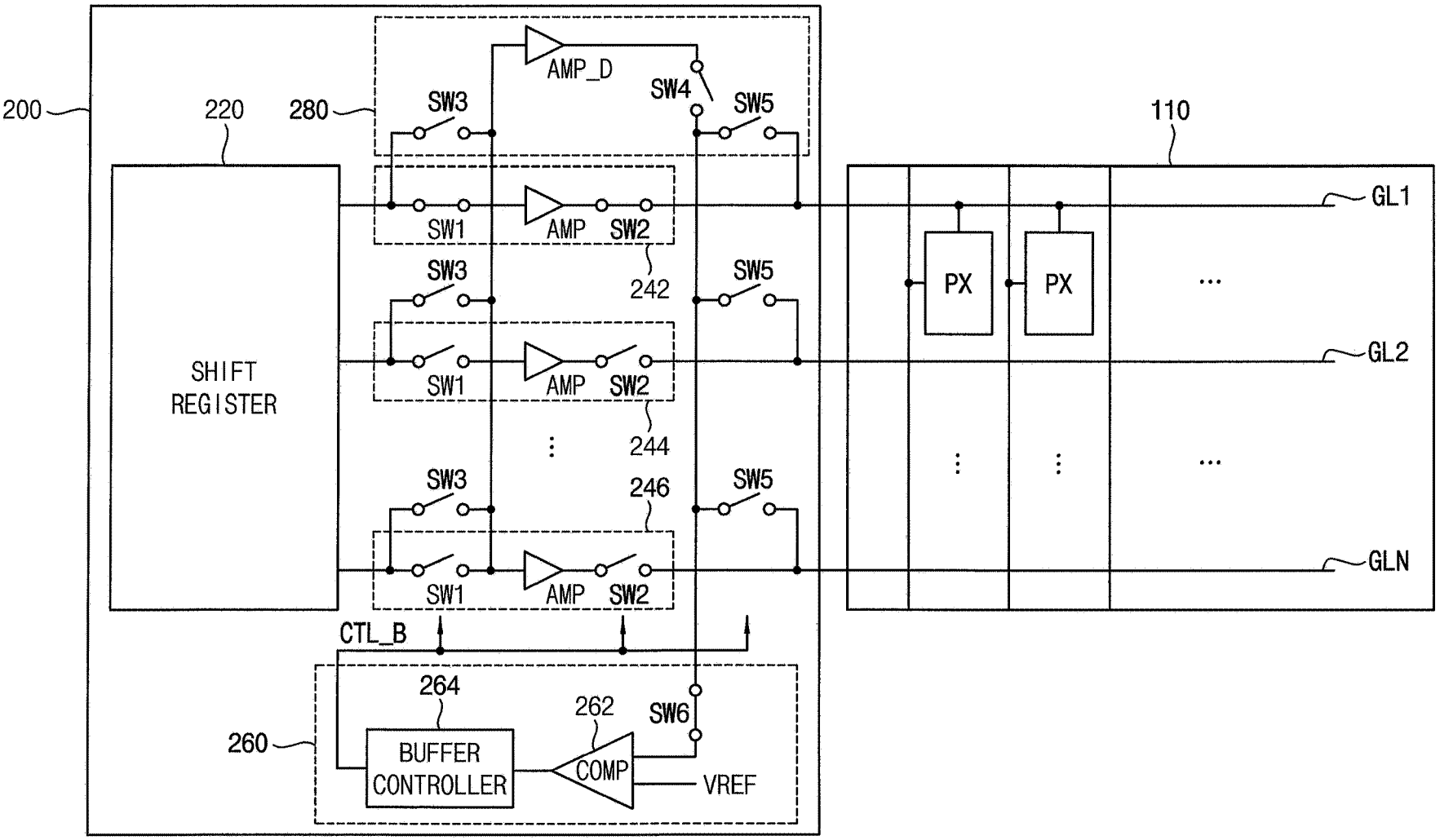
FIGS. 6A-6C are diagrams illustrating an operation of the gate driver of FIG. 4.
Figure 6B:
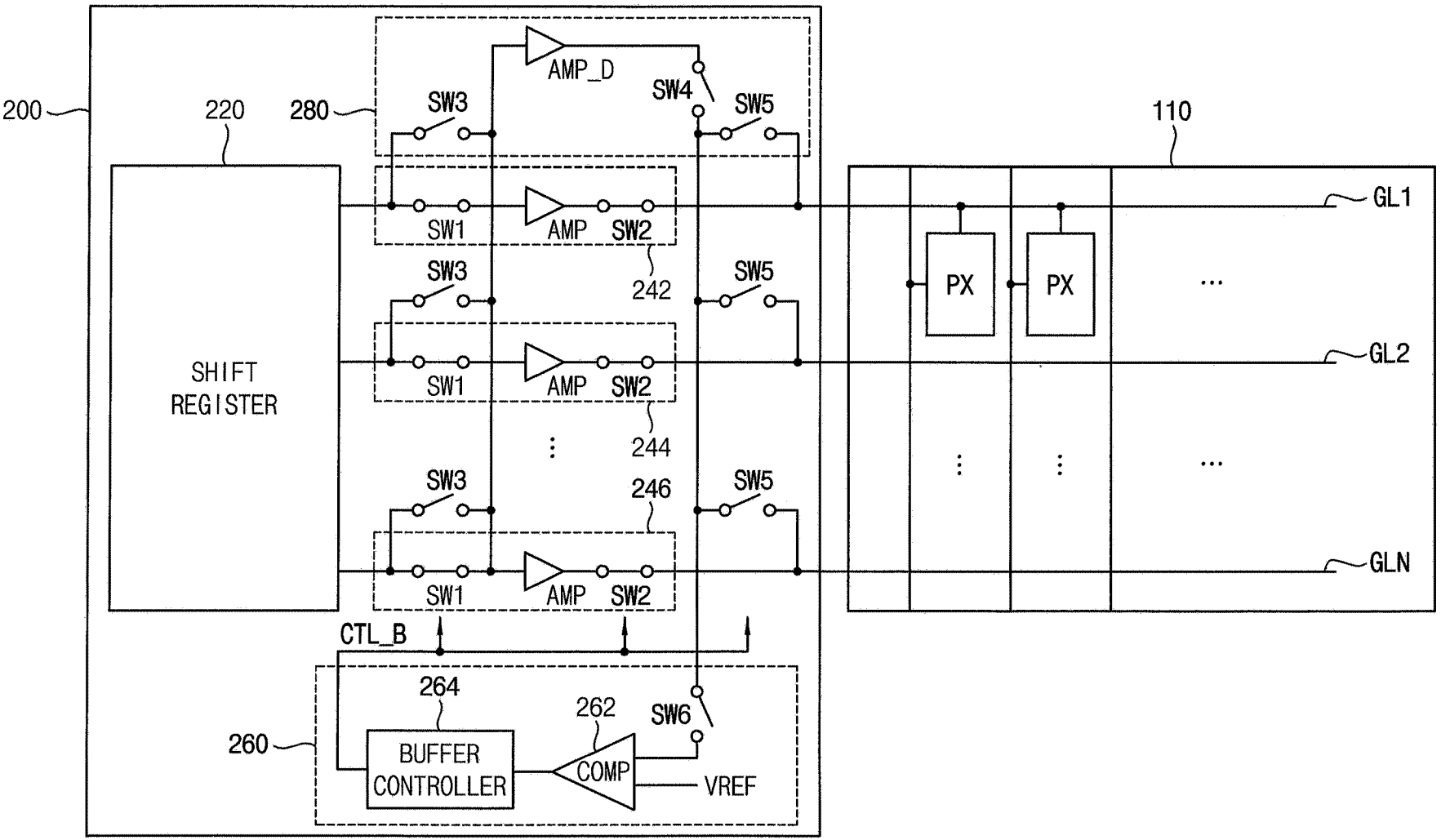
Figure 6C:
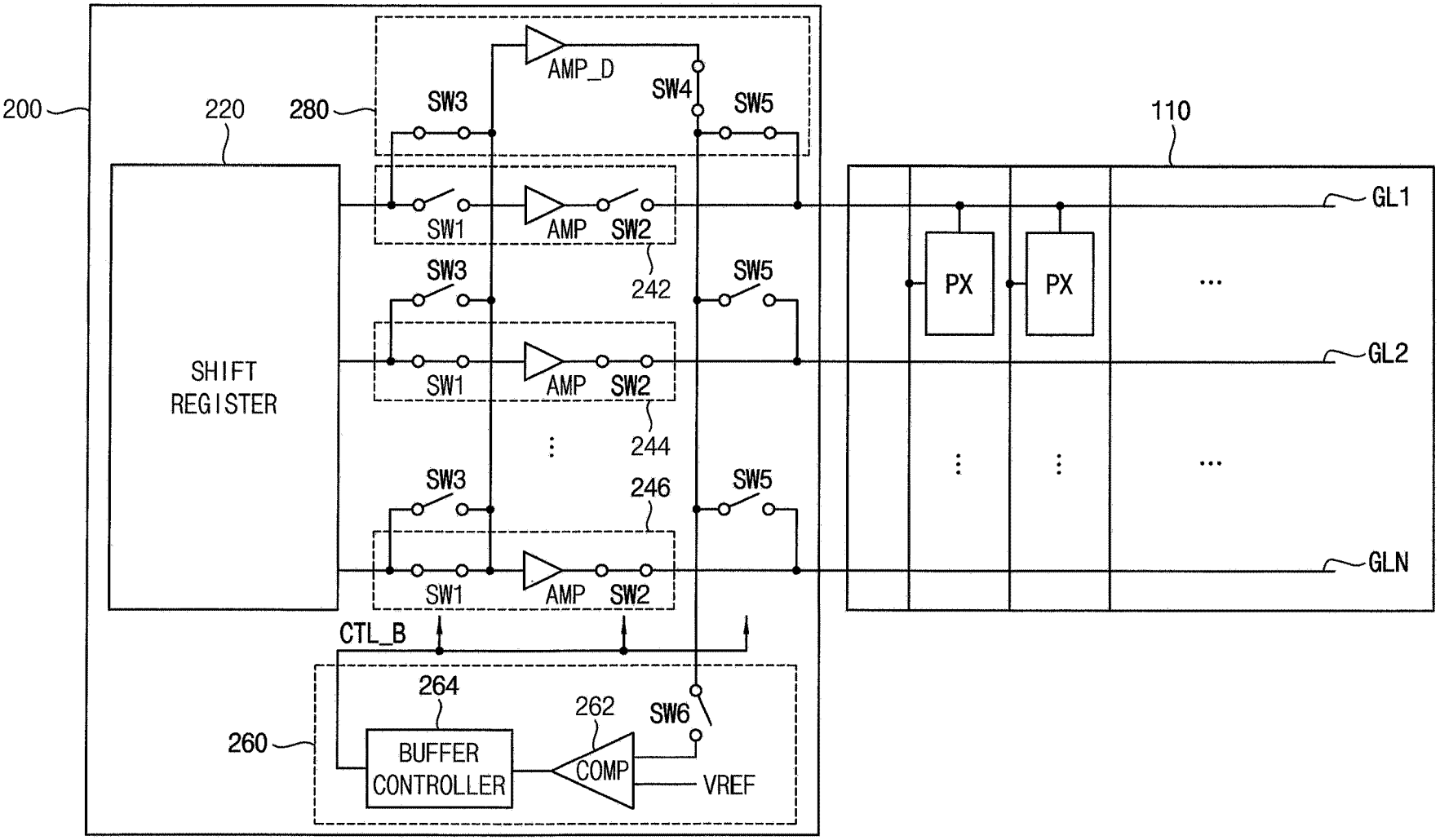

FIGS. 6A-6C are diagrams illustrating an operation of the gate driver of FIG. 4.

Referring to FIG. 6A, the detector 260 may sequentially sense the gate signals output form the output buffers 242, 244, 246 when the sixth switch SW6 turns on. When the sixth switch SW6 turns on, a line that outputs the gate signal and the detector 260 may be coupled. In some example embodiments, the detector 260 may sequentially sense the gate signals output from the output buffers 242, 244, 246 at a power-on timing of the display device. In other example embodiments, the detector 260 may sequentially sense the gate signals output from the output buffers 242, 244, 246 during a vertical blank period in a frame. Thus, a user may not recognize a display abnormality although an abnormal gate signal is provided to the display panel 110.

The detector 260 may sequentially sense the gate signals output from the output buffers 242, 244, 246 coupled to the first through Nth gate lines GL1 through GLN. The first switch SW1 and the second switch SW2 of the output buffers 242, 244, 246 may sequentially turn on in a sensing period. For example, the first switch SW1 and the second switch SW2 of the first output buffer 242 coupled to the first gate line GL1 may turn on, and the detector 260 may sense the gate signal output from the first output buffer 242. After, the first switch SW1 and the second switch SW2 of the first output buffer 242 may turn off, the first switch SW1 and the second switch SW2 of the second output buffer 244 coupled to the second gate line GL2 may turn on, and the detector 260 may sense the gate signal output from the second output buffer 244. The sixth switch SW6 of the detector 260 may turn on, and the gate signals output from the output buffers 242, 244, 246 may be provided to the comparator 262 of the detector 260 while the gate signals are sensed. The buffer controller 264 of the detector 260 may output the buffer control signal CTL_B based on a comparing result of the comparator 262.

Referring to FIG. 6B, when the voltage level of the gate signal is greater than or equal to the voltage level of the reference voltage VREF, the detector 260 may output the buffer control signal CTL_B that turns on the first switch SW1 and the second switch SW2. When the voltage level of the gate signal is greater than or equal to the voltage level of the reference voltage VREF, the output buffer 242, 244, 246 may be coupled between the shift register 220 and the gate line GL1 through GLN because the amplifier AMP of the output buffer 242, 244, 246 may be operating as normal or desired. When all of the gate signals output to the gate lines GL1 through the GLN have or are in a normal or desired range, the first switch SW1 and the second switch SW2 of the output buffers 242, 244, 246 may turn on, and the amplifiers AMP of the output buffers 242, 244, 246 may be coupled between the shift register 220 and the gate lines GL1 through the GLN as described in FIG. 6B.

Referring to FIG. 6C, when the gate signal is less than the reference voltage VREF, the detector 260 may output the buffer control signal CTL_B that runs on or through the third switch SW3, the fourth switch SW4, and the fifth switch SW5. When one of the gate signals output to one of the gate lines GL1 through GLN is less than the reference voltage VREF, it is determined that the amplifier AMP of the output buffer that outputs the gate signal is abnormal or not operating at a desired level. Thus, the dummy output buffer 280 may be coupled between the shift register 220 and one of the gate lines GL1 through GLN instead of the output buffer that outputs the gate signal of which voltage level is less than the reference voltage VREF. For example, when the gate signal output from the first output buffer 242 coupled to the first gate line GL1 is less than the reference voltage VREF, the first switch SW1 and the second switch SW2 may turn off, and the third switch SW3, the fourth switch SW4, and the fifth switch SW5 may turn on as described in FIG. 6C. Thus, the dummy amplifier AMP_D of the dummy output buffer 280 may be coupled between the shift register 220 and the first gate line GL1 instead of the first output buffer 242 coupled to the first gate line GL1.

As described above, the gate driver 200 according to example embodiments may sequentially sense each of the gate signal output from the output buffers 242, 244, 246 and couple the dummy amplifier AMP_D of the dummy output buffer 280 between the shift register 220 and the gate line instead of the amplifier AMP of the output buffers 242, 244, 246 when the voltage level of the gate signal is less than the voltage level of the reference voltage, so that the line defect occurred due to the abnormal gate signal may be reduced or prevented.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the inventive concept refers to "one or more embodiments of the inventive concept."

It will be understood that when an element or layer is referred to as being "on" or "coupled to" another element or layer, it can be directly on or coupled to the other element or layer, or one or more intervening elements or layers may be present. In contrast, when an element or layer is referred to as being "directly on" or "directly coupled to" another element or layer, there are no intervening elements or layers present.

As used herein, the terms "use," "using," and "used" may be considered synonymous with the terms "utilize," "utilizing," and "utilized," respectively.

The electronic or electric devices and/or any other relevant devices or components according to embodiments of the present disclosure described herein, such as, for example, a timing controller, a data driver, and a gate driver, may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of ordinary skill in the art should recognize that the functionality of various computing/electronic devices may be combined or integrated into a single computing/electronic device, or the functionality of a particular computing/electronic device may be distributed across one or more other computing/electronic devices without departing from the spirit and scope of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and equivalents thereof.

What is claimed is:

1. A gate driving circuit comprising:

a shift register configured to generate a plurality of output signals based on at least one clock signal;

a plurality of output buffers configured to generate a plurality of gate signals by amplifying the output signals and to sequentially output the gate signals to a plurality of gate lines in a display panel;

a detector configured to sequentially sense the gate signals and to compare each of the gate signals to a reference voltage; and a dummy output buffer configured to be coupled between the shift register and a gate line of the gate lines instead of an output buffer of the output buffers when a voltage level of a corresponding gate signal from the output buffer is less than a voltage level of the reference voltage.

2. The gate driving circuit of claim 1, wherein each of the output buffers comprises:

an amplifier configured to generate a corresponding gate signal by amplifying a corresponding output signal;

a first switch coupled between the shift register and the amplifier; and a second switch coupled between the amplifier and a corresponding gate line.

3. The gate driving circuit of claim 2, wherein the dummy output buffer comprises:

a dummy amplifier configured to generate the gate signal by amplifying the output signal;

a third switch coupled between the shift register and the dummy amplifier;

a fourth switch coupled between the dummy amplifier and the gate line; and a fifth switch coupled between the dummy amplifier and the gate line.

4. The gate driving circuit of claim 3, wherein the detector comprises:

a comparator configured to compare each of the gate signals output from the output buffers to the reference voltage;

a sixth switch coupled between the output buffers and the comparator; and a buffer controller configured to generate a buffer control signal to control the first through fifth switches based on an output of the comparator.

5. The gate driving circuit of claim 4, wherein when the voltage level of the gate signal from the output buffer is greater than or equal to the voltage level of the reference voltage, the first switch of the output buffer and the second switch of the output buffer turn on based on the buffer control signal.

6. The gate driving circuit of claim 4, wherein when the voltage level of the gate signal from the output buffer is less than the voltage level of the reference voltage, the third switch, the fourth switch, and the fifth switch turn on based on the buffer control signal.

7. The gate driving circuit of claim 4, wherein the detector is configured to sense each of the gate signals output from the output buffers when the sixth switch turns on.

8. The gate driving circuit of claim 4, wherein the first through fifth switches are p-channel metal oxide semiconductor transistors.

9. The gate driving circuit of claim 4, wherein the first through fifth switches are n-channel metal oxide semiconductor transistors.

10. The gate driving circuit of claim 4, wherein the first switch and the second switch are p-channel metal oxide semiconductor transistors, and the third switch, the fourth switch, and the fifth switch are n-channel metal oxide semiconductor transistors.

11. The gate driving circuit of claim 4, wherein the first switch and the second switch are n-channel metal oxide semiconductor transistors, and the third switch, the fourth switch, and the fifth switch are p-channel metal oxide semiconductor transistors.

12. A display device comprising:

a display panel comprising a plurality of gate lines, a plurality of data lines, and a plurality of pixels;

a gate driver configured to provide a plurality of gate signals to the pixels through the gate lines;

a data driver configured to provide a plurality of data signals to the pixels through the data lines; and a timing controller configured to generate a plurality of control signals to control the gate driver and the data driver, wherein the gate driver comprises:

a shift register configured to generate a plurality of output signals based on at least one clock signal;

a plurality of output buffers configured to generate the gate signals and sequentially output the gate signals to the gate lines;

a detector configured to sequentially sense the gate signals and compare each of the gate signals to a reference voltage; and a dummy output buffer configured to be coupled between the shift register and a gate line of the gate lines instead of an output buffer of the output buffers when a voltage level of a corresponding gate signal from the output buffer is less than a voltage level of the reference voltage.

13. The display device of claim 12, wherein each of the output buffers comprises:

an amplifier configured to generate a corresponding gate signal by amplifying a corresponding output signal;

a first switch coupled between the shift register and the amplifier; and a second switch coupled between the amplifier and a corresponding gate line.

14. The display device of claim 13, wherein the dummy output buffer comprises:

a dummy amplifier configured to generate the gate signal by amplifying the output signal;

a third switch coupled between the shift register and the dummy amplifier;

a fourth switch coupled between the dummy amplifier and the gate line; and a fifth switch coupled between the dummy amplifier and the gate line.

15. The display device of claim 14, wherein the detector comprises:

a comparator configured to compare each of the gate signals output from the output buffers to the reference voltage;

a sixth switch coupled between the output buffers and the comparator; and a buffer controller configured to generate a buffer control signal to control the first through fifth switches based on an output of the comparator.

16. The display device of claim 15, wherein when the voltage level of the gate signal from the output buffer is greater than or equal to the voltage level of the reference voltage, the first switch of the output buffer and the second switch of the output buffer turn on based on the buffer control signal.

17. The display device of claim 15, wherein when the voltage level of the gate signal from the output buffer is less than the voltage level of the reference voltage, the third switch, the fourth switch, and the fifth switch turn on based on the buffer control signal.

18. The display device of claim 15, wherein the detector is configured to sense each of the gate signals output from the output buffers when the sixth switch turns on.

19. The display device of claim 15, wherein the detector is configured to sense each of the gate signals output from the output buffers at a power-on timing of the display device.

20. The display device of claim 15, wherein the detector is configured to sense each the gate signals output from the output buffers during a vertical blank period in a frame.

* * * * *